US006598661B2

(12) United States Patent
Schwenecke

(10) Patent No.: US 6,598,661 B2
(45) Date of Patent: Jul. 29, 2003

(54) COOLED CONTINUOUS-CASTING MOLD

(75) Inventor: Siegbert Schwenecke, Moers (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 09/981,662

(22) Filed: Oct. 16, 2001

(65) Prior Publication Data

US 2002/0043356 A1 Apr. 18, 2002

(30) Foreign Application Priority Data

Oct. 17, 2000 (DE) ..... 100 51 489

(51) Int. Cl.[7] ..... B22D 11/04; B22D 11/124
(52) U.S. Cl. ..... 164/418; 164/443
(58) Field of Search ..... 164/418, 443, 164/459, 485

(56) References Cited

U.S. PATENT DOCUMENTS

| | | | | |
|---|---|---|---|---|
| 4,390,057 A | | 6/1983 | Reuter | 164/459 |
| 5,201,909 A | * | 4/1993 | Von Wyl et al. | 164/418 |
| 6,192,972 B1 | | 2/2001 | Mantovan | 164/430 |

FOREIGN PATENT DOCUMENTS

| | | | | |
|---|---|---|---|---|
| BE | 554 091 | * | 1/1957 | |
| DE | 15 08 898 | | 11/1969 | |
| DE | 25 49 011 | | 5/1976 | B22D/11/06 |
| FR | 2 584 322 | * | 1/1987 | B22D/11/14 |
| GB | 962 259 | * | 7/1964 | |
| GB | 1 529 338 | * | 10/1978 | B22D/11/04 |
| LU | 66012 | * | 1/1973 | |

* cited by examiner

*Primary Examiner*—Kuang Y. Lin
*Assistant Examiner*—Kevin P. Kerns
(74) *Attorney, Agent, or Firm*—Herbert Dubno; Andrew Wilford

(57) ABSTRACT

A continuous-casting mold has two parallel and spaced mold end plates having opposite ends and inner and outer faces and two parallel and spaced mold side plates extending generally perpendicular to the end plates, having inner and outer faces, and having opposite ends bearing on the respective side-plate ends. The inner faces form a generally rectangular mold passage having four corners. Respective rigid cooler plates bearing inward on the outer faces of the mold plates have ends at the corners. Respective clamps at the corners engage the cooler-plate ends, press the cooler plates inward on the mold plates, and thereby press the side-plate ends against the end-plate ends.

10 Claims, 1 Drawing Sheet

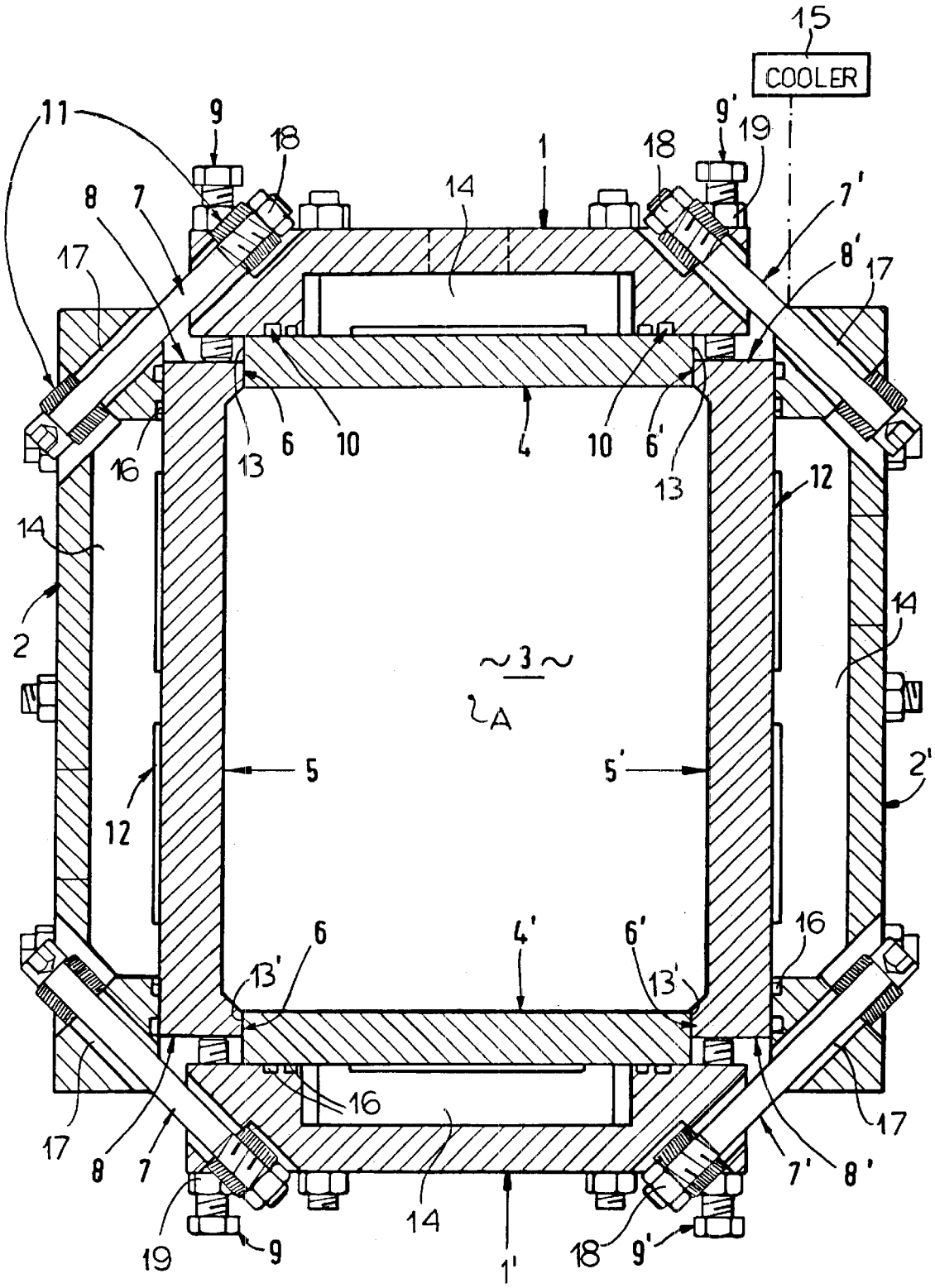
15
COOLER
11
9
18
1
18
9'
19
14
7
8
7'
8'
17
17
16
13
6
10
4
10
6'
13
12
14
2
14
~3~
A
5
5'
2'
12
6
4'
6'
16
13'
13'
16
17
17
8
7
7'
8'
19
9
14
1'
18
9'

COOLED CONTINUOUS-CASTING MOLD

FIELD OF THE INVENTION

The present invention relates to a continuous-casting mold. More particularly this invention concerns such a mold which is water cooled.

BACKGROUND OF THE INVENTION

In continuous casting, liquid metal, typically steel, is poured into one end of a throughgoing mold passage and is cooled so that, before it exits the opposite end of the passage, it has solidified and has enough structural integrity to form a strand that can be handled. Typically the passage is vertical with the molten metal being poured into the top and the solid strand being pulled out of the bottom.

In the system described in U.S. Pat. No. 6,192,972 of Mantovan the mold is made of male and female mold sections carried on respective endless chains having vertical adjacent stretches. As the mold sections move together at the top of the vertical stretches they form the passage, then move down slowly with the strand and separate at the bottom, to return on outer stretches. This system is extremely complex and difficult to control. The molten steel causes extreme wear and erosion of the mold sections which must be remachined and replaced often.

The mold of U.S. Pat. No. 4,390,057 of Reuter is formed of two parallel end plates and two parallel side plates together forming the mold passage. Ends of the side plates bears on end edges of the end plates, and shims are provided between the plates to maintain the passage in a predetermined shape. As the mold plates wear, shims are removed to maintain the shape. Such a system requires a complex harness arrangement to hold it together and no provision is made for cooling. The periodic adjustment for wear is difficult and requires a long down time.

The standard method of cooling such a mold is to provide large molded coolers that are bolted to the outside faces of the mold plates and through which water is passed so as to cool these outside faces and, by conduction, the metal in contact with the inside faces of the plates. To secure these coolers in place, it is necessary to provide the normally copper mold plates with threaded steel inserts cooperating with bolts, an arrangement that is, once again, quite complex.

German patent 25 49 011 of Rohrig provides cooling passages on outer faces of the mold plates that cooperate with other structure to form chambers a coolant can flow through. This system has the mold plates engaged together at angled end surfaces so that a rigid frame is needed to maintain the mold passage square. With time the wear and erosion of the plates causes leaks and breakouts that require wholesale replacement of the mold plates.

OBJECTS OF THE INVENTION

It is therefore an object of the present invention to provide an improved water-cooled continuous-casting mold.

Another object is the provision of such an improved water-cooled continuous-casting mold which overcomes the above-given disadvantages, that is which is of simple construction yet which is durable and which remains a tight seal even if worn.

SUMMARY OF THE INVENTION

A continuous-casting mold has according to the invention two parallel and spaced mold end plates having opposite ends and inner and outer faces and two parallel and spaced mold side plates extending generally perpendicular to the end plates, having inner and outer faces, and having opposite ends bearing on the respective side-plate ends. The inner faces form a generally rectangular mold passage having four corners. Respective rigid cooler plates bearing inward on the outer faces of the mold plates have ends at the corners. Respective clamps at the corners engage the cooler-plate ends, press the cooler plates inward on the mold plates, and thereby press the side-plate ends against the end-plate ends.

The cooler-plate ends in accordance with the invention are formed with angled bores and the clamp includes tie bolts each engaging at the respective corner through the respective bores of two adjacent cooler plates and each having ends bearing diagonally on the respective cooler-plate ends. The bolts are wholly out of contact with the mold plates and extend normally at 45° to the planes of the mold plates.

Thus with this system the mold plates, which are subject to enormous abuse and wear in normal use, can be of relatively simple construction. They do not have to be finely machined, threaded, bored, and/or formed with cooling passages. Instead they can be basically flat castings and all that really needs to be done to them is machining a planar seal surface at each end.

Respective springs according to the invention are braced between each bolt and at least one of the respective cooler plates. These springs are packs of spring washers, one such pack of spring washers normally provided between each end of each bolt and the respective cooler plate. Thus the mold plates and cooler plates can even shift somewhat relative to each other without separating. This prevents breakout leaks and allows the system to accommodate to the often drastic temperature changes encountered in normal use.

The mold plates as mentioned above are all generally planar. The end mold plates have end edges extending perpendicular to the end plates and the side mold plates have end edges extending parallel to the side plates and bearing flatly on the end edges of the end plates. Thus the spacing between the side plates is determined by the width of the end plates, but the end plates can move limitedly parallel to the side plates to adjust the spacing between them. Only the mold-plate edges need be machined; the other surfaces can mainly be left as cast. Means are provided according to the invention for shifting the end plates parallel to the side plates. This means includes bolts engaging through the cooler plates and bearing on the side plates. As the end-plate coolers move in and out, the respective end plates move with them.

The mold plates have smooth and uninterrupted outer faces engaging the respective cooler plates. Each cooler plate forms a cavity open toward the outer face of the respective mold plate so that coolant can be pumped through the cavities to cool the plates. Furthermore, each cooler plate has an inner face flatly engaging the respective mold-plate outer face and formed with a normally annular groove open toward the respective mold plate. Respective seals seated in the grooves engage the respective mold-plate outer faces and prevent leakage from the cooling cavities.

BRIEF DESCRIPTION OF THE DRAWING

The above and other objects, features, and advantages will become more readily apparent from the following description, reference being made to the accompanying drawing whose sole figure is a horizontal cross section through a mold according to the invention.

SPECIFIC DESCRIPTION

As seen in the drawing a continuous-casting mold is formed by end and side cooler plates 1, 1', 2, and 2', end and side mold plates 4, 4', 5, and 5' forming with the cooler plates 1, 1', 2, and 2' a square-section mold passage 3 centered on an axis A, and tie bolts 7 and 7' securing the assembly together.

According to the invention the end plates 4 and 4' are spaced from and parallel to each other and have planar end edges 13 and 13' that bear against inner end faces 6 and 6' of ends 8 and 8' of the side plates 5 and 5'. These plates 4, 4', 5, and 5' are all of simple construction with no through-going holes, threaded inserts, or the like requiring complex machining. They need only be accurately machined at the planar faces 6, 6', 13, and 13', the faces 6 and 6' being parallel to the planes of the respective plates 5 and 5' and the faces 13 and 13' being perpendicular to the planes of the respective plates 4 and 4'.

According to the invention the cooler plates 1, 1', 2, and 2' are formed with chambers or cavities 14 connected via feed slots 12 to a cooler 15 that circulates water through them. Each plate 1, 1', 2, and 2' is basically formed as a square flat cup so that the outside face of the respective plate 4, 4', 5, and 5' is directly contacted by the water in the respective chambers 14. Grooves 10 on the cooler-plate faces bearing on the plates 4, 4', 5, and 5' hold compressible seals 16 that prevent leakage from the chambers 14. Furthermore, the ends of each cooler plate 1, 1', 2, and 2' are formed with 45° diagonal bores 17 through which pass the bolts 7 and 7', packs 11 of Belleville washers bearing inward on the plates 1, 1', 2, and 2'. Thus the fasteners 7 and 7' will hold the entire mold together without actually themselves touching the mold plates 4, 4', 5, and 5'. The spring packs 11 ensure that the assembly will remain tight even during the substantial thermal expansion and contraction the mold goes through in normal use. Nuts 18 on the bolts 7 and 7' allow the tension in the packs 11 to be adjusted.

The spacing between the plates 5 and 5' is determined by the width between the faces 13 and 13' of the plates 4 and 4'. The spacing between the plates 4 and 4'; however, is adjustable here by bolts 9 and 9' projecting parallel to the plates 5 and 5 through the cooler plates 1 and 1'. Inner ends of these bolts 9 and 9' bear on the end faces 8 and 8' of the plates 5 and 5'. The molten metal filling the cavity 3 presses the plates 4, 4', 5, and 5' outward with great force. Thus as the inner faces of the plates 4, 4', 5, and 5' are worn away, it is possible to move in the plates 4 and 4' by backing off the bolts 9 and 9' slightly. Lock nuts 19 allow the positions of the bolts 9 and 9' to be fixed.

I claim:

1. A continuous-casting mold comprising:

two parallel and spaced mold end plates having oppositely directed ends and inner and outer faces;

two parallel and spaced mold side plates extending generally perpendicular to the mold end plates, having inner and outer faces, and having opposite ends bearing on the respective mold end-plate ends with the mold end elates lying between the mold side-plate ends, the inner faces forming a generally rectangular mold passage having four corners;

respective rigid side and end cooler plates bearing inward on the outer faces of the mold side and end plates and having ends at the corners formed with angled bores; and respective tie bolts extending diagonally of the mold elates through the bores at the corners, having bolt ends bearing diagonally on the cooler-plate ends, pressing the cooler plates inward on the respective side and end mold plates, and thereby pressing the mold side-plate ends against the mold end plate ends, the bolts being wholly out of contact with the mold plates, and respective springs braced between each bolt and at least one of the respective cooler plates.

2. The continuous-casting mold defined in claim 1 wherein the springs are packs of spring washers.

3. The continuous-casting mold defined in claim 2 wherein one such pack of spring washers is provided between each end of each bolt and the respective cooler plate.

4. The continuous-casting mold defined in claim 1 wherein the mold plate inner faces are all generally planar, the end mold plates having end edges extending perpendicular to the inner faces of the mold end plates and the side mold plates having end edges extending parallel to the inner faces of the mold side plates and bearing flatly on the end edges of the mold end plates.

5. The continuous-casting mold defined in claim 4, further comprising means for shifting the mold end plates parallel to the mold side plates.

6. The continuous-casting mold defined in claim 5 wherein the shifting means includes bolts engaging through the cooler plates and bearing on the mold side plates.

7. The continuous-casting mold defined in claim 1 wherein the mold plates are all generally planar and have smooth and uninterrupted outer faces engaging the respective cooler plates.

8. The continuous-casting mold defined in claim 7 wherein each cooler plate forms a cavity open toward the outer face of the respective mold plate, whereby coolant can be pumped through the cavities to cool the plates.

9. The continuous-casting mold defined in claim 7 wherein each cooler plate has an inner face flatly engaging the respective mold-plate outer face and formed with a groove open toward the respective mold plate, the mold further comprising respective seals seated in the grooves and engaging the respective mold-plate outer faces.

10. The continuous-casting mold defined in claim 1 wherein the ends of each mold end plate are planar and parallel to each other and flatly engage the mold side-plate ends, whereby the end plates can slide parallel to their ends between the side plates.

* * * * *